US005621997A

United States Patent [19]

Pearce

[11] Patent Number: 5,621,997

[45] Date of Patent: Apr. 22, 1997

[54] HANDGUN GRIP ENHANCER

[75] Inventor: R. Lane Pearce, Bothell, Wash.

[73] Assignee: Pearce Grip, Inc., Bothell, Wash.

[21] Appl. No.: 592,965

[22] Filed: Jan. 29, 1996

[51] Int. Cl.[6] ..... F41C 23/10

[52] U.S. Cl. ..... 42/71.02; 42/7; 42/72; 42/74

[58] Field of Search ..... 42/7, 71.02, 72, 42/74, 90

[56] References Cited

U.S. PATENT DOCUMENTS

| | | | |
|---|---|---|---|
| D. 349,938 | 8/1994 | Hogue et al. | D22/108 |
| 3,672,084 | 6/1972 | Pachmayr | 42/71.02 |
| 3,685,194 | 8/1972 | Coon | 42/72 |
| 3,815,270 | 6/1974 | Pachmayr | 42/71.02 |
| 3,901,125 | 8/1975 | Raville | 89/163 |
| 4,043,066 | 8/1977 | Pachmayr et al. | 42/71.02 |
| 4,132,024 | 1/1979 | Pachmayr et al. | 42/74 |
| 4,148,149 | 4/1979 | Pachmayr et al. | 42/71.02 |
| 4,242,824 | 1/1981 | Pachmayr et al. | 47/71.02 |
| 4,286,401 | 9/1981 | Pachmayr et al. | 42/71.02 |
| 4,771,562 | 9/1988 | Ruger | 42/71.02 |
| 4,936,036 | 6/1990 | Sniezak et al. | 42/71.02 |
| 4,998,367 | 3/1991 | Leibowitz | 42/71.02 |
| 5,231,237 | 7/1993 | Cupp | 42/71.02 |
| 5,293,708 | 3/1994 | Strayer et al. | 42/75.03 |
| 5,465,520 | 11/1995 | Cupp | 42/71.02 |

FOREIGN PATENT DOCUMENTS

| | | | |
|---|---|---|---|
| 1805399 | 8/1970 | Germany | 42/71.02 |

*Primary Examiner*—Stephen M. Johnson
*Attorney, Agent, or Firm*—Dowrey & Associates

[57] ABSTRACT

A handgun grip enhancer unit for use with side panel grip type handguns. The unit is made from elastomer and includes a forward finger rest cushion member molded integral with reduced thickness side wing members which extend rearwardly in full face engagement with the gun handle and beneath the standard side panel grip elements.

11 Claims, 3 Drawing Sheets

HANDGUN GRIP ENHANCER

BACKGROUND OF THE INVENTION

1. Field of the Invention

The present invention relates to hand grip assemblies for handguns and more particularly to a device for enhancing the quality and functionality of the standard factory-supplied hand grip assembly. The device of the present invention is combined and cooperates with the standard factory-supplied side panel grip elements.

2. Description of the Prior Art

It has become increasingly popular in the handgun or pistol grip art to utilize grips and grip assemblies composed of rubber or some other relatively soft elastomer for a number of reasons. The use of elastomers in the grip assembly provides for a better "feel" in the user's hand and may provide a certain amount of bulk or sizing to otherwise standard factory produced grips. The concept of elastomer grips has also resulted in rather complex structures including rigid inserts for reinforcing as well as additional cavities to enhance the shock absorbing ability of the elastomer material. The following listed U.S. patents are examples of elastomer grip assemblies wherein the elastomer or composite elastomer and stiffener materials comprise the entire integrated grip assembly:

| U.S. Pat. No. | Date | Inventor |
|---|---|---|
| 3,672,084 | 6/1972 | Pachmayr |
| 3,815,270 | 6/1974 | Pachmayr |
| 4,043,066 | 8/1977 | Pachmayr et al |
| 4,132,024 | 1/1979 | Pachmayr et al |
| 4,148,149 | 4/1979 | Pachmayr et al |
| 4,242,824 | 1/1981 | Pachmayr et al |
| 4,936,036 | 6/1990 | Sniezak et al |

The examples of elastomer grips in the above group of patents are the type which constitute original equipment or could possibly entirely replace the standard panel grips on the gun handle. This type of structure does not anticipate the present concept of an after-market unit designed to cooperate with the standard usually rigid side panel grip elements.

The following group of U.S. patents illustrate further examples of elastomer grip elements which include a forward portion with finger rests or indentations which further accommodate the user's fingers.

| U.S. Patent No. | Date | Inventor |
|---|---|---|
| 4,998,367 | 3/1991 | Leibowitz |
| 5,465,520 | 11/1995 | Cupp |
| Des 349,938 | 8/1994 | Hogue et al |

As illustrated in the Leibowitz U.S. Pat. No. 4,998,367 and the Hogue et al Design U.S. Pat. No. 349,938, the finger rests may be formed as an integral part of a unitary or sectioned elastomer grip. In other instances, the forward elastomer finger grip element may be formed as a separate element of a compound assembly such as in the Cupp U.S. Pat. No. 5,465,520. In these types of arrangements, the unitary, sectioned or multiple membered grip operates as a complete assembly which cooperates with the handle of the handgun.

The patent to Ruger, U.S. Pat. No. 4,771,562, as well as the Leibowitz U.S. Pat. No. 4,998,367 listed above are both examples of integral elastomer pistol grip units which include side stiffener panels located in recesses in the sidewalls of the elastomer body. Thus the panel inserts 21 and 22 of the Ruger patent are contained in the side recesses 27 and 28 of the elastomer body. The inserts 40 of the Leibowitz patent are contained in the recesses 41 of the elastomer grip. In these examples, the inserts are completely surrounded by the elastomer material and, in effect, serve to stiffen the elastomer body.

The following listed U.S. patents illustrate examples of grip assemblies which include separate forward panels in addition to side panel grip elements providing finger rest surfaces for the gun handle.

| U.S. Pat. No. | Date | Inventor |
|---|---|---|
| 3,901,125 | 8/1975 | Raville |
| 4,286,401 | 9/1981 | Pachmayr et al |
| 5,231,237 | 7/1993 | Cupp |

The patent to Raville U.S. Pat. No. 3,901,125, listed above utilizes a metallic shield member 78 which covers the front surface of the gun handle and has narrow rear edge strips which underlie the forward edge of side panel grips 22. Although these edges overlap there is no cooperation between the side panel grip elements and the front panel 78. In the Pachmayer et al U.S. Pat. No. 4,286,401 listed above, the forward elastomer unit 34 is covered by the forward edges of the elastomer grip 75 but is attached to the gun handle by means of the locking tabs 61, 62 and 64, 65. There is thus no functional cooperation between the side panelled grips and the forward panel 34. In the Cupp U.S. Pat. No. 5,231,237, the forward section 27 is made of an elastomer material and has side panels 74 which rest within a cavity in the grip body 26 and are held there by means of the bolts 29. The forward panel 27 thus functions as both side panel grips and forward finger rest.

The patent to Strayer, U.S. Pat. No. 5,293,708, is cited as being of interest for its showing of a front finger rest panel made integral with the side panel grips.

None of the above patents disclose the structural features or advantages of applicant's grip enhancer unit. The grip enhancers of the present invention is designed to provide a single unitary element which may be used as an after-market attachment which cooperates with and retains the standard factory provided side panel grip elements.

SUMMARY OF THE INVENTION

The present invention provides an after-market elastomer grip enhancer unit which is adaptable, with slight variations, to accommodate any standard handgun handle of the panel grip type. The unit enhances the standard factory made grip by providing a front panel with finger rest indentations and with flexible elastomer side wings or plates designed to underlie the original rigid side panel grip elements for any particular gun. The side wing elements of the elastomer grip enhancer underlie substantially the entire inside surface of the side panel grip elements providing positive anchoring for the forward elastomer panel. The wing member also serve to provide additional "bulk" to the gun grip and provide an element of cushioning between the rigid side panel grip elements and the metal gun handle. The grip enhancer element of the present invention may additionally be utilized to provide cosmetic effects such as a two-tone appearance and to add distinctive styling to the otherwise standard configuration. In the event additional cushioning or additional thickness is desired for the overall grip, elastomer shims may be added to the grip enhancer. With the use of the present invention, the gun owner may retain the elements of the original factory-supplied grip while enhancing its appearance and utility.

DESCRIPTION OF THE PREFERRED EMBODIMENT

Figure 1:
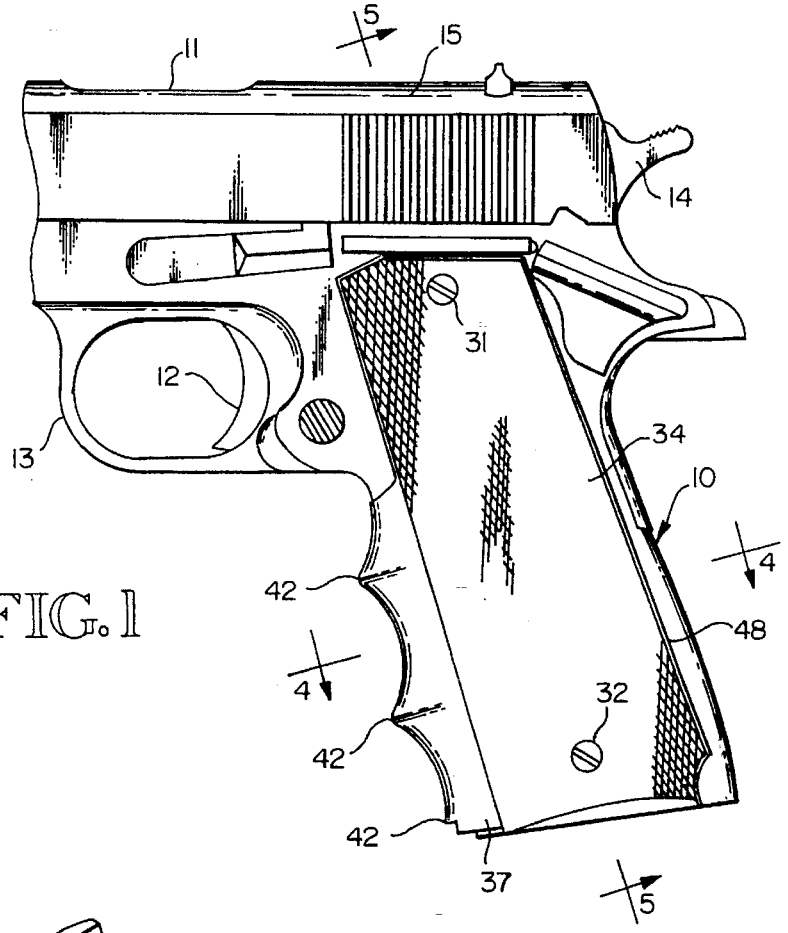
FIG. 1 is a side elevational view of the grip assembly including the elastomer grip enhancer and the standard side panel grips.
Figure 2:
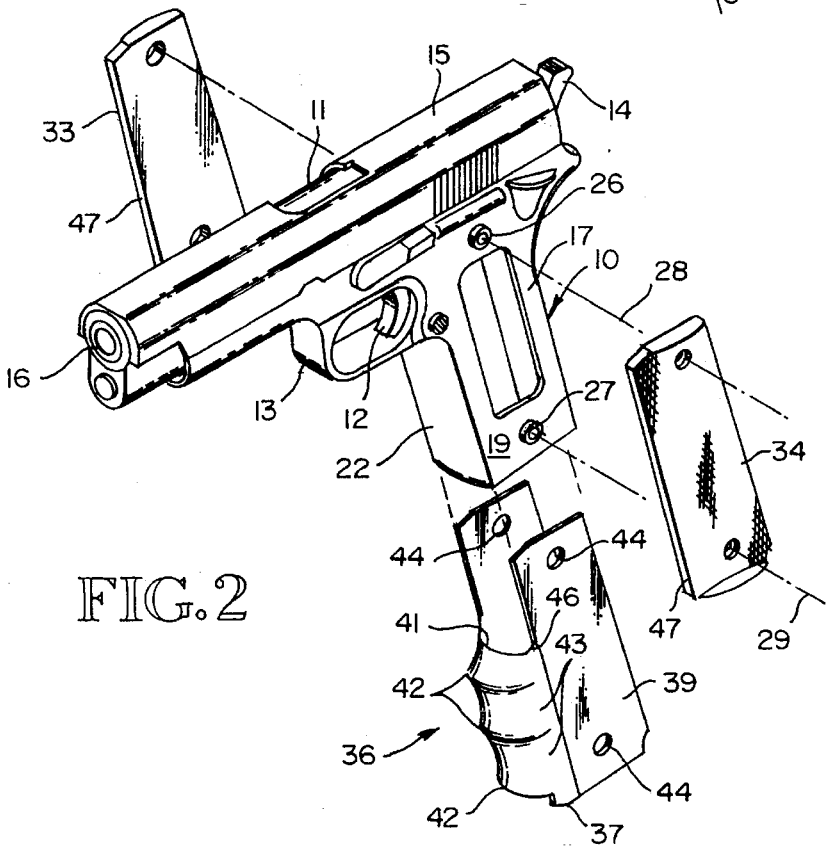
FIG. 2 is an exploded view of the gun handle, grip enhancer and side panel grips.

Referring to FIGS. 1 and 2 of the drawings, the handgun shown by way of illustration may be characterized in the art as the Colt Government Model 1911 or an equivalent. While the present invention is described with relation to this specific handgun it will be understood that the features of the present invention may be applied to grips for any number of different types of handguns or pistols. For purposes of definition, as used throughout this specification and claims, the term "side panel grip" type shall mean a handgun with a handle having substantially planar opposite side surfaces to which are applied side panel grip elements usually attached by screw threaded means. The illustrated gun includes a downwardly projecting hollow handle 10 to which the grip enhancer unit of the present invention is applied. The handle normally functions to house an ammunition clip which is insertable into the interior of the handle from its lower end to feed a series of rounds successfully to the chamber 11 of the gun for firing. The trigger 12, provided with the usual trigger guard 13, controls the operation of the hammer 14. The hammer is automatically cocked by the recoiling movement of the slide 15 surrounding the barrel 16.

Figure 4:
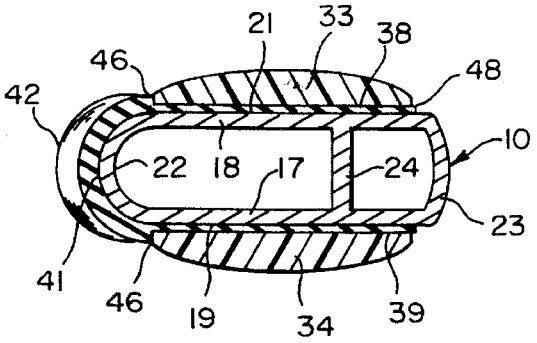
FIG. 4 is a cross sectional view taken along lines 4—4 of FIG. 1.
Figure 5:
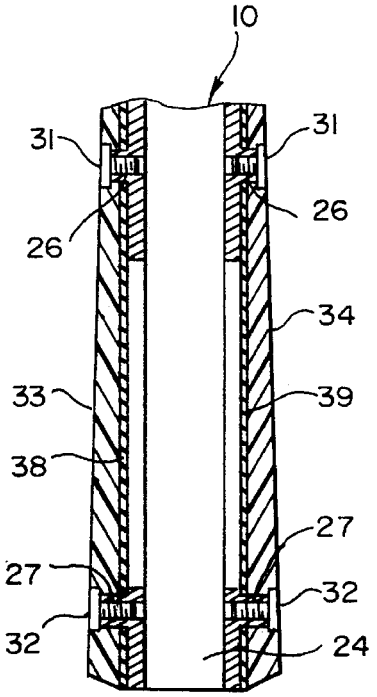
FIG. 5 is a cross sectional view taken along lines 5—5 of FIG. 1.

As seen in FIG. 2, the handle 10 of the pistol has two parallel essentially planar vertically extending opposite side walls 17 and 18, having oppositely facing outer planar parallel vertical surfaces 19 and 21 respectively. At the front of the handle, the two side walls 17 and 18 are connected together by a forward wall portion 22 which is usually rounded to provide a normally smooth finger grip. In a similar manner, the two side walls 17 and 18 are connected at the rear of the handle by means of a second curved rear wall portion 23 which may also be slightly curved in order to accommodate the user's hand. A cross brace 24 extends between the two side walls 17 and 18 as shown in FIGS. 4 and 5. Each of the side walls 17 and 18 of the gun handle carry the upper and lower outwardly projecting locating bosses 26 and 27 which are externally cylindrical about the horizontal axes 28 and 29 respectively. These axes extend perpendicular to the planar opposite side surfaces 19 and 21 of the handle. The bosses contain internal threads for reception of screws 31 and 32 which are utilized to secure the standard or factory produced right and left panel grip elements 33 and 34 respectively.

The structure described thus far may be considered to be a standard equipment which is part of the factory supplied gun unit. With some variations the elements and overall general configuration of the gun handle will be similar for most handguns. The existence of substantially planar side wall grip mounting surfaces on the gun handle, the forward surface connecting the side wall surfaces and the demountable feature of the side panel grip elements are the features utilized in conjunction with the grip enhancer unit of the present invention.

Figure 3:
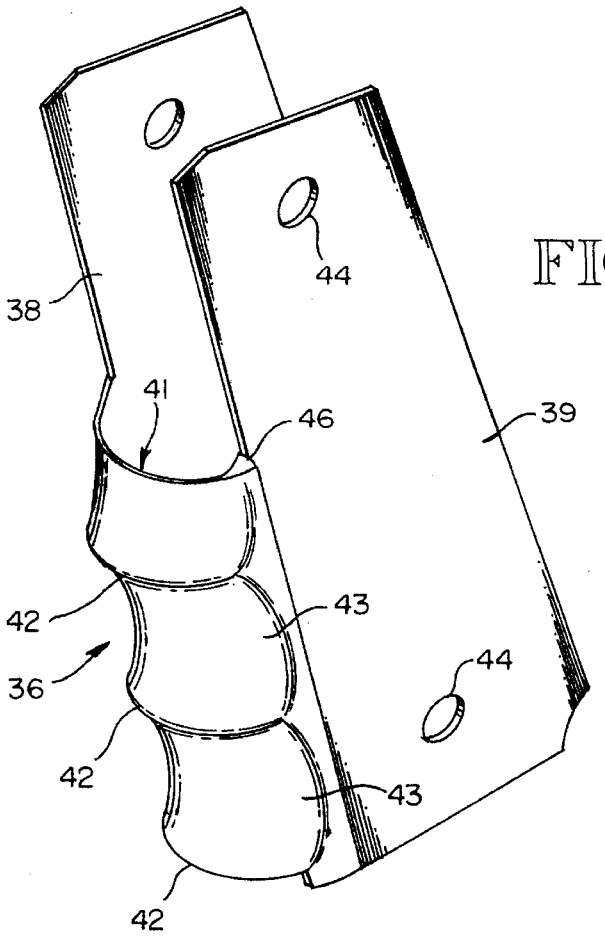
FIG. 3 is an isometric view of the grip enhancer;.

The grip enhancer unit 36 of the present invention is shown most completely in FIG. 3 with its relationship to the gun handle 10 and standard side panel grips 33, 34 being depicted in the exploded view of FIG. 2. The components of the grip enhancer 36 include a forward grip cushioning element or cross strap 37 and right and left hand wing members forming side plates 38 and 39 respectively. The grip enhancer 36 is molded from a suitable elastomeric material as an integral unit. The elastomer may be soft neoprene or other rubber compounds commonly used cushion type handgun grips. Likewise, the durometer of the material may be chosen for the desired "feel", and cushioning and appearance qualities, and may range from a fairly stiff to a relatively soft resilient and flexible material. Any well known molding process may be used to form the unit.

The forward grip cushioning member 37 has a curved inside surface 41 designed to lie flat against the curved outside surface of the forward wall 22 of the gun handle as shown in FIG. 4. The cushion member 37 may be formed with a relatively thickened wall to provide the desired cushioning for the user's fingers. In the embodiment shown, multiple horizontal ribs 42 project forward from the front surface of the cushioning member to define horizontal grooves 43 for receiving a user's fingers. The number of finger rests may, of course, be varied according to the size and style of the gun handle. Other features, such as surface finish or texture for the grip enhancer unit, may also be adopted without departing from the spirit and scope of the present invention.

As aforementioned, the grip enhancer is formed with integral molded side wings 38 and 39 which, although they may vary in thickness, are of a reduced thickness overall, relative to the body of the forward cushioning member 37. These wings form flexible side plates which include accurately placed holes 44 designed to engage the four bosses 26, 27 on the gun handle surfaces 19, 21 to accurately hold the grip enhancer in position. Because the flat inside surfaces of the side plates 38 and 39 fully engage the handle surfaces and are pressured thereagainst by the side panel grip elements 33, 34, the grip enhancer is perfectly aligned and firmly held in position for gripping. It will be understood that, although the inner and outer planar surfaces of the wings 38 and 39 are illustrated as smooth, the surface texture or treatment may be varied for any desired effect.

The side panel grip elements 33 and 34 are normally of a stiff and rigid construction, being usually made of wood or some synthetic thermoplastic material. These grip elements are usually provided with a knurled or cross hatched diamond pattern outer surface and a smooth planar inside surface which lies in flat face engagement with the surfaces 19 and 21 of the metal gun handle. The grip elements are held against the gun handle surfaces by means of screw fasteners 31, 32 which engage the bosses 26, 27. As depicted in the exploded view of FIG. 2, the side panel grip elements 33 and 34 are removed and the thin elastomeric wing members 38 and 39 are passed over the gun handle 10 with the bosses 26, 27 engaging the holes 44 therein. The grip panels are then replaced over the elastomeric wing plates and held in place by the screws 31, 33 in the usual manner.

As shown in FIG. 4, the thickened cushioning cross member 37 is provided with a shoulder 46 which mates with the lower forward edge 47 of the associated side panel grip element. In order to present a pleasing accent, the edges of the wing members 38 and 39 may also be extended slightly as at 48, seen in FIG. 1, to project beyond the peripheral edges of the side panel grips. Alternatively the edges of the wing members may be made flush with the grip element edges.

Figure 6:
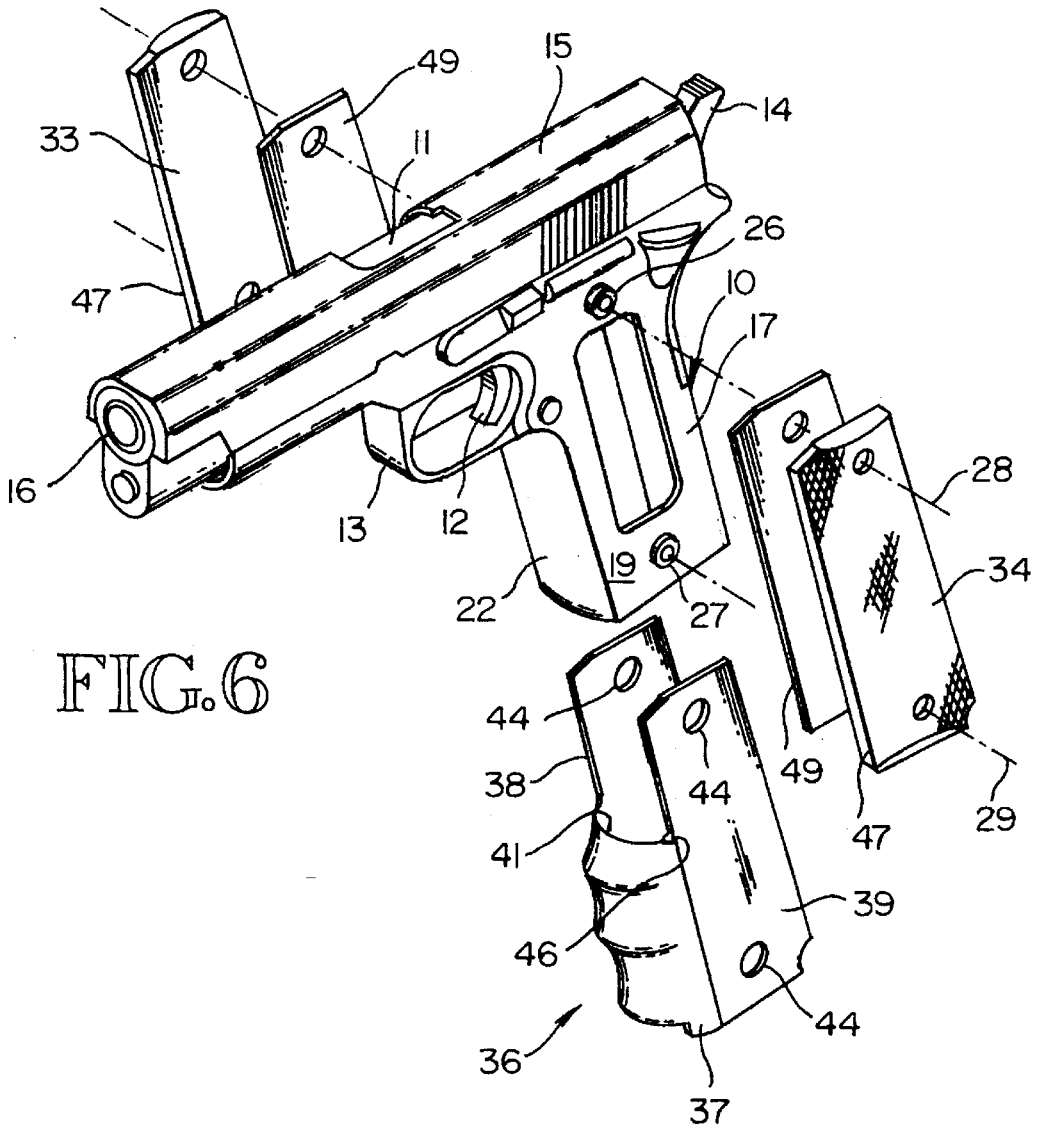
FIG. 6 is an exploded view of the gun handle, grip enhancer and shims.

The provision of the full sized wing members 38, 39 of the grip enhancer not only firmly anchors the forward cushioning member but also provides a degree of cushioning for the grip elements by isolating them from the gun handle. Additionally the extra thickness provided by the wing members enhances the "feel" by adding bulk to the grip. Since the handgun is normally manufactured for the "average" hand size, the grip enhancer acts as an adjustment to the grip sizing. In this connection, elastomeric shim members 49, shown in FIG. 6, may be used to further increase the bulk of the grip and, of course, provide additional cushioning and shock absorption. The shims 49 may be made from any material of desired durometer but will preferably be made of the same elastomer material as the grip enhancer. The peripheral contour of the shims may be identical to that of the wing members 38, 39 or may be sized to provide additional accented outline to the grip in general.

It will thus be understood that, while the present invention has been described relative to a specific embodiment, the invention is susceptible to many modifications in order to adapt it to different handgun designs and configurations. Accordingly, it is desired to comprehend such modifications within the invention as may fall within the scope of the appended claims.

What is claimed is:

1. An enhancer for adding bulk to the grip of a side panel grip type handgun handle having a front edge and planar side surfaces and separate removable side panel grip elements with separate attachment means for normally attaching the elements with one surface thereof in direct contact with the planar sides of the gun handle comprising, in combination;

a flexible elastomeric grip body including a vertical cross panel, and laterally spaced side wing anchor members attached to opposite side edges of said cross panel and extending therefrom between the grip elements and the handle in engagement with the side surfaces of the gun handle, said side wing anchor members including mounting openings constructed and arranged to register with the attachment means for said side grip elements and to cover substantially the entire surface of the grip elements, said wing anchor members substantially conforming and limited to the contours of the grip elements.

2. The grip enhancer of claim 1 wherein;

said vertical cross panel comprises a cushioning finger rest adapted to contact the front edge of said gun handle.

3. The grip enhancer of claim 2 wherein;

said panel grip elements include forward edges and said wing anchor members are of reduced thickness relative to said cross panel, said cross panel including;

shoulder surfaces for engaging a portion of the forward edge of each said side panel grip.

4. A grip enhancer for a side panel grip type handgun handle, said handle having a front edge and side grip elements with attachment means therefor comprising, in combination;

a molded elastomer grip body including a vertical cross panel comprising a cushioning finger rest adapted to contact the front edge of said gun handle, laterally spaced side wing anchor members attached to opposite side edges of said cross panel and extending therefrom to underlie substantially the entire area of the associated side grip element, and an elastomer shim plate extending between each said wing anchor member and the associated grip element, each said shim conforming substantially to the peripheral contour of the wing anchor members.

5. A grip enhancer for a side panel grip type handgun handle having a vertical front edge and attachment means for releasably fixing the grips to the gun handle, comprising in combination;

a molded elastomer grip body including a vertical cross panel constructed and arranged to contact the vertical front edge surface of said gun handle, said cross panel comprising a cushioning finger rest and including shoulder surfaces for engaging a portion of the forward edges of said side panel grips, laterally spaced side wing members attached to said cross panel and extending therefrom and underlying substantially the entire area of the associated side panel grip, said wing members comprising flexible plates of reduced thickness relative to said cross panel and including openings constructed and arranged to register with the attachment means for said side panel grips, said wing member contacting the side surfaces of the gun handle when clamped between said handle and the associated side panel grip, and an elastomer shim plate extending between each said wing members and the associated side panel grip, each said shim conforming substantially to the peripheral contour of the wing members, whereby said grip enhancer is anchored and the bulk of said side panel grip is enhanced.

6. A grip enhancer for removable attachment to a conventional side panel grip type handgun having a handle with opposite vertical side surfaces, separate removable hand grip panel elements having inside surfaces designed for normal direct engagement at fixed attachment points with said vertical side surfaces, said handle including a front edge surface designed for normally contacting the user's fingers; said handle, side panel grip elements and front edge surface comprising the conventional manufacturer's grip assembly, said grip enhancer comprising;

an integral grip body composed of elastomeric material and having a vertical cross panel and laterally spaced side wing members extending therefrom, said side wing members substantially conforming to and substantially limited to the peripheral contours of said hand grip elements and each including inside and outside planar surfaces, said inside surfaces adapted to engage said planar vertical surfaces of the gun handle, said outside surfaces adapted to engage substantially the entire inside surfaces of said hand grip elements, and said wing members including openings arranged to register with said attachment points of said grip elements, whereby said wing members may be engaged directly on the vertical side surfaces of the gun handle and said panel grip elements attached to the gun handle overlying said wing members.

7. The grip enhancer of claim 6 wherein; said vertical cross panel comprises a finger rest adapted to contact the front edge of said gun handle.

8. The grip enhancer of claim 7 wherein;

said panel grip elements include forward edges and said wing members are of reduced thickness relative to said cross panel, said cross panel member including;

shoulder surfaces for engaging a portion of the forward edge of each said side grip elements.

9. The grip enhancer of claim 8 wherein said grip elements include attachment means for releasably fixing the grip elements to the gun handle, said wing members including;

openings constructed and arranged to register with the attachment means for said grip elements.

10. In a side panel grip type handgun handle having a front edge and planar vertical side surfaces with hand grip elements having attachment means for removably attaching the grip elements thereto at fixed attachment points, said grip elements having inside surfaces for engagement with said vertical side surface a grip enhancer comprising;

an integral grip body composed of elastomeric material and having a vertical cross panel comprising a finger rest adapted to contact the front edge of said gun handle and laterally spaced side wing members extending therefrom underlying substatially the entire area of the associated grip element, said cross panel member including shoulder surfaces for engaging a portion of the forward edge of said side grip elements, said side wing members each comprising flexible plates of reduced thickness relative to said cross panel including inside and outside planar surfaces, said inside surfaces adapted to engage said planar vertical surfaces of the gun handle, said outside surface adapted to engage the inside surfaces of said hand grip elements, said wing members including openings arranged to register with said attachment points of said grip elements, and an elastomer shim plate extending between each said wing members and the associated side panel grip element, each said shim plates conforming substantially to the peripheral contour of the associated side wing member, whereby said wing members may be engaged directly on the vertical side surfaces of the gun handle and said panel grip elements attached to the gun handle overlying said wing members.

11. A grip enhancer for a side panel grip type handgun handle having side panel grip elements with attachment means therefor comprising, in combination;

a molded elastomer grip body including a vertical cross panel, laterally spaced side wing anchor members attached to opposite side edges of said cross panel and extending therefrom, said side wing anchor members including mounting openings constructed and arranged to register with the attachment means for said side grip elements, and an elastomer shim plate extending between each said wing anchor members and the associated grip element, each said shim conforming substantially to the peripheral contour of the wing and anchor members.

* * * * *

UNITED STATES PATENT AND TRADEMARK OFFICE

CERTIFICATE OF CORRECTION

PATENT NO. : 5,621,997

DATED : April 22, 1997

INVENTOR(S) : R. Lane Pearce

It is certified that error appears in the above-identified patent and that said Letters Patent is hereby corrected as shown below:

Col 4, line 22, insert --for-- after "used"

Col 7, line 27, insert a comma (,) after "surfaces"--.

Signed and Sealed this

First Day of July, 1997

Bruce Lehman

*Attest:*

BRUCE LEHMAN

*Attesting Officer*

*Commissioner of Patents and Trademarks*